US008251552B2

(12) United States Patent
Rooms et al.

(10) Patent No.: US 8,251,552 B2
(45) Date of Patent: Aug. 28, 2012

(54) LIGHTING APPARATUS AND CONNECTOR PLATE

(75) Inventors: Rob Allen Rooms, Miamiville, OH (US); John D. Boyer, Lebanon, OH (US)

(73) Assignee: LSI Industries, Inc., Cincinnati, OH (US)

( * ) Notice: Subject to any disclaimer, the term of this patent is extended or adjusted under 35 U.S.C. 154(b) by 307 days.

(21) Appl. No.: 12/731,077

(22) Filed: Mar. 24, 2010

(65) Prior Publication Data

US 2010/0188845 A1 Jul. 29, 2010

Related U.S. Application Data

(63) Continuation-in-part of application No. 12/254,107, filed on Oct. 20, 2008, now Pat. No. 7,972,035.

(60) Provisional application No. 60/982,240, filed on Oct. 24, 2007.

(51) Int. Cl.
*F21V 17/00* (2006.01)
*F21S 8/04* (2006.01)

(52) U.S. Cl. ..... 362/365; 362/147; 362/364

(58) Field of Classification Search ..... 362/147, 362/364, 365

See application file for complete search history.

(56) References Cited

U.S. PATENT DOCUMENTS

| | | | | |
|---|---|---|---|---|
| 5,155,303 | A | 10/1992 | Bensel, III et al. | |
| 5,173,025 | A | 12/1992 | Asami | |
| 5,309,342 | A * | 5/1994 | Heinen, Sr. | 362/364 |
| 5,481,443 | A | 1/1996 | Wagner et al. | |
| 5,522,769 | A | 6/1996 | Deguiseppi | |
| 5,609,408 | A | 3/1997 | Targetti | |
| 6,547,426 | B1 | 4/2003 | Ebara | |
| 6,893,139 | B2 | 5/2005 | Cercone et al. | |
| 7,025,477 | B2 * | 4/2006 | Blessing et al. | 362/364 |
| 7,159,997 | B2 | 1/2007 | Reo | |
| 7,168,825 | B2 * | 1/2007 | McArthur | 362/267 |
| 7,311,423 | B2 | 12/2007 | Frecska | |
| 7,600,883 | B2 * | 10/2009 | Deng | 362/96 |
| 7,722,227 | B2 * | 5/2010 | Zhang et al. | 362/364 |
| 7,828,465 | B2 * | 11/2010 | Roberge et al. | 362/294 |
| 7,862,214 | B2 * | 1/2011 | Trott et al. | 362/365 |

(Continued)

FOREIGN PATENT DOCUMENTS

DE 20 2009 013561 U1 12/2009

OTHER PUBLICATIONS

International Search Report and the Written Opinion from corresponding PCT/US2011/027647 dated May 19, 2011.

*Primary Examiner* — Peggy A. Neils

(74) *Attorney, Agent, or Firm* — McDermott Will & Emery LLP

(57) ABSTRACT

Lighting apparatus and structures are described that are adapted for installation in housings. The housings can be pre-existing ones, such as those installed for high-intensity discharge (HID) or other types of lighting. The lighting apparatus can include a light unit (e.g., luminaire) with desired type of light source(s), for example, an array of LEDs. The apparatus can include structures that are adapted for use with the housings such that installation of a light unit requires a minimum of user effort and time. Such lighting apparatus, and related installation methods, can accordingly provide for high-efficiency lighting. Related assembly and installation techniques are also described.

23 Claims, 6 Drawing Sheets

U.S. PATENT DOCUMENTS

| | | | | |
|---|---|---|---|---|
| 7,959,332 | B2 * | 6/2011 | Tickner et al. | 362/373 |
| 2001/0049857 | A1 | 12/2001 | Uchida et al. | |
| 2002/0044443 | A1 | 4/2002 | Kira et al. | |
| 2002/0118544 | A1 | 8/2002 | Wang et al. | |
| 2003/0161153 | A1 | 8/2003 | Patti | |
| 2004/0090785 | A1 | 5/2004 | McInnis | |
| 2005/0241103 | A1 | 11/2005 | Dobson et al. | |
| 2006/0133094 | A1 * | 6/2006 | Yang | 362/346 |
| 2006/0146531 | A1 | 7/2006 | Reo | |
| 2006/0193142 | A1 | 8/2006 | Dupre | |
| 2006/0262542 | A1 | 11/2006 | Ibbitson et al. | |
| 2007/0064425 | A1 | 3/2007 | Frecska | |
| 2008/0084698 | A1 | 4/2008 | Kinnune et al. | |
| 2010/0009621 | A1 * | 1/2010 | Hsieh | 454/293 |

* cited by examiner

LIGHTING APPARATUS AND CONNECTOR PLATE

RELATED APPLICATIONS

This application is a continuation-in-part of U.S. patent application Ser. No. 12/254,107, filed Oct. 20, 2008 and entitled "Adjustable Lighting Apparatus," which claims priority to U.S. Provisional Patent Application No. 60/982,240, filed Oct. 24, 2007; the entire contents of both of which application are incorporated herein by reference.

BACKGROUND

Light panels, sometimes referred to as "luminaires," are typically designed to provide a downward and outward distribution of light for many applications, including exterior illumination of gasoline service stations, convenience stores and drive-through restaurants, for example. Canopy luminaires typically include a box-like canopy fixture housing mounted to a horizontal ceiling or canopy support structure for enclosing and supporting lighting components and related structure of the canopy luminaire. The lighting components of the canopy luminaire include electrical control elements, such as ballasts, capacitors and ignitors, which are electrically coupled to a high intensity discharge (HID) lamp. The lamp is typically mounted horizontally in a lamp socket within the canopy fixture, and a reflector is provided above the light-emitting section of the lamp to distribute light downwardly through a glass or plastic lens assembly which encloses the lamp.

Replacement or conversion of canopy luminaires generally requires several or all of the existing lighting components and related structure of the luminaire to be removed from the existing canopy fixture housing to provide sufficient room in the fixture housing for installation of the replacement luminaire. In the past, replacement canopy luminaires have been shipped from the manufacturer as disassembled components which are then individually mounted and wired in the canopy fixture housing. It will be appreciated, however, that installation and wiring of the separate retrofit luminaire components in an existing canopy fixture installation is a complicated and time consuming process as the canopy fixture is generally only accessible by ladder. As any location or site may require replacement or conversion of ten or more canopy luminaires, the difficulty associated with installing, mounting and wiring separate retrofit components of the existing canopy luminaires is significantly increased.

Thus, there is a need for a luminaire assembly which minimizes the time required to retrofit an existing canopy luminaire. There is also a need for a luminaire assembly which improves the simplicity and ease of installation of a retrofit luminaire assembly in an existing canopy fixture housing.

SUMMARY

It is to be understood that both the foregoing summary of the present disclosure and the following detailed description are exemplary and explanatory and are not intended to limit the scope of the present disclosure. Moreover, with regard to terminology used herein, a reference to an element in the singular is not intended to mean "one and only one" unless specifically stated, but rather "one or more." The term "some" refers to one or more. Underlined and/or italicized headings and subheadings are used for convenience only, do not limit the present disclosure, and are not referred to in connection with the interpretation of the description of the present disclosure.

Aspects and embodiments of the of the present disclosure address problems previously described by providing lighting apparatus that are adapted for installation in housings. The housings can be pre-existing, such as those installed for high-intensity discharge (HID) or other types of lighting. The lighting apparatus can include a desired type of light source (s), for example, an array of LEDs. The apparatus can include structures that are adapted for use with the housings such that installation of a light unit requires a minimum of user effort and time.

An aspect of the present disclosure is directed to lighting apparatus that can be adapted for installation in a fixture housing having a flange at a lower end thereof surrounding and defining an opening in the fixture housing. The apparatus can include a connector plate having an upper surface, a lower surface, an outer perimeter, and an aperture defined by an inner perimeter. The connector plate is adapted to fit against and be connected to the flange of the housing. The connector plate can be configured and arranged to securably receive a driver plate for a lighting power unit. The apparatus can include a light panel including a lighting unit. The apparatus can also include an external mounting panel. The external mounting panel can be configured and arranged to securably receive the connector plate and the light panel.

An embodiment of the connector plate can include fastener structures adjacent the inner perimeter and adjacent the outer perimeter.

The lighting apparatus can include a lighting power unit for operating the lighting unit and electrically coupled to the lighting unit.

The lighting power unit can be supported on a driver plate secured to the connector plate.

The flange of the housing can include one or more resilient clips.

The connector plate can include a safety hook configured to receive a safety cable attached to the exterior mounting panel.

The exterior mounting panel can include one or more (e.g., two) keyhole slots for receiving respective fasteners, e.g., screws.

The housing flange can include an inner surface that is spaced apart from a canopy of the housing, and wherein the connector plate further comprises one or more tabs with support surfaces adapted to mate with the inner surface of the housing flange.

The lighting unit can include a plurality of LEDs.

The lighting unit can include a housing having an optic.

A sealant can be disposed between the connector plate and the housing flange.

The lighting apparatus can include a plurality of fasteners connecting the connector panel to the housing flange.

The lighting apparatus can include a plurality of fasteners connecting the external mounting panel to the connector plate.

The lighting apparatus can include a plurality of fasteners connecting the light panel to the external mounting panel.

A further aspect of the present disclosure is directed to a method of installing a lighting apparatus in an existing fixture having a housing with an inwardly directed flange at a lower end thereof surrounding and defining an opening in the fixture housing, the fixture housing further having a ballast coupled to a power source through a first set of electrical leads, a first lamp socket coupled to the ballast through a second set of electrical leads, a lamp mounted in the first lamp socket, a reflector and a lens assembly covering the opening. The method comprising can include removing the lens assembly from the fixture housing to expose the interior of the housing through the opening therein. The first set of electrical leads coupled to the ballast can be disconnected. The lamp and the reflector can be removed from the fixture housing. A connector plate can be provided that includes an upper surface and a lower surface, an outer perimeter, and an aperture defined by an inner perimeter. The connector plate can be adapted to fit against and be connected to the flange of the housing. The connector plate can be configured and arranged to securably receive a driver plate for a lighting power unit. A light panel can be provided that includes a lighting unit or luminaire. An external mounting panel can be provided as part of the method. The external mounting panel can be configured and arranged to securably receive the connector plate and the light panel.

The light panel can be connected to the external mounting panel.

The connector plate can be connected to the housing flange.

The external mounting panel can be connected to the connector plate.

Connecting the external mounting panel to the connector plate can include connecting a safety hook attached to the connector plate to a safety cable connected to the external mounting panel.

A power control unit can be provided.

Sealant can be applied/provided between the flange and the connector plate.

The housing flange can include an inner surface that is spaced apart from a canopy of the housing. The connector plate can include one or more tabs with support surfaces adapted to mate with the inner surface of the housing flange.

The light unit comprises a plurality of LEDs.

It will be appreciated that the foregoing embodiments and aspects can be combined or arranged in any practical combinations.

Other features of embodiments of the present disclosure will be apparent from the description, the drawings, and the claims herein.

BRIEF DESCRIPTION OF THE DRAWINGS

Aspects of the disclosure may be more fully understood from the following description when read together with the accompanying drawings, which are to be regarded as illustrative in nature, and not as limiting. The drawings are not necessarily to scale, emphasis instead being placed on the principles of the disclosure. In the drawings.

Figure 1:
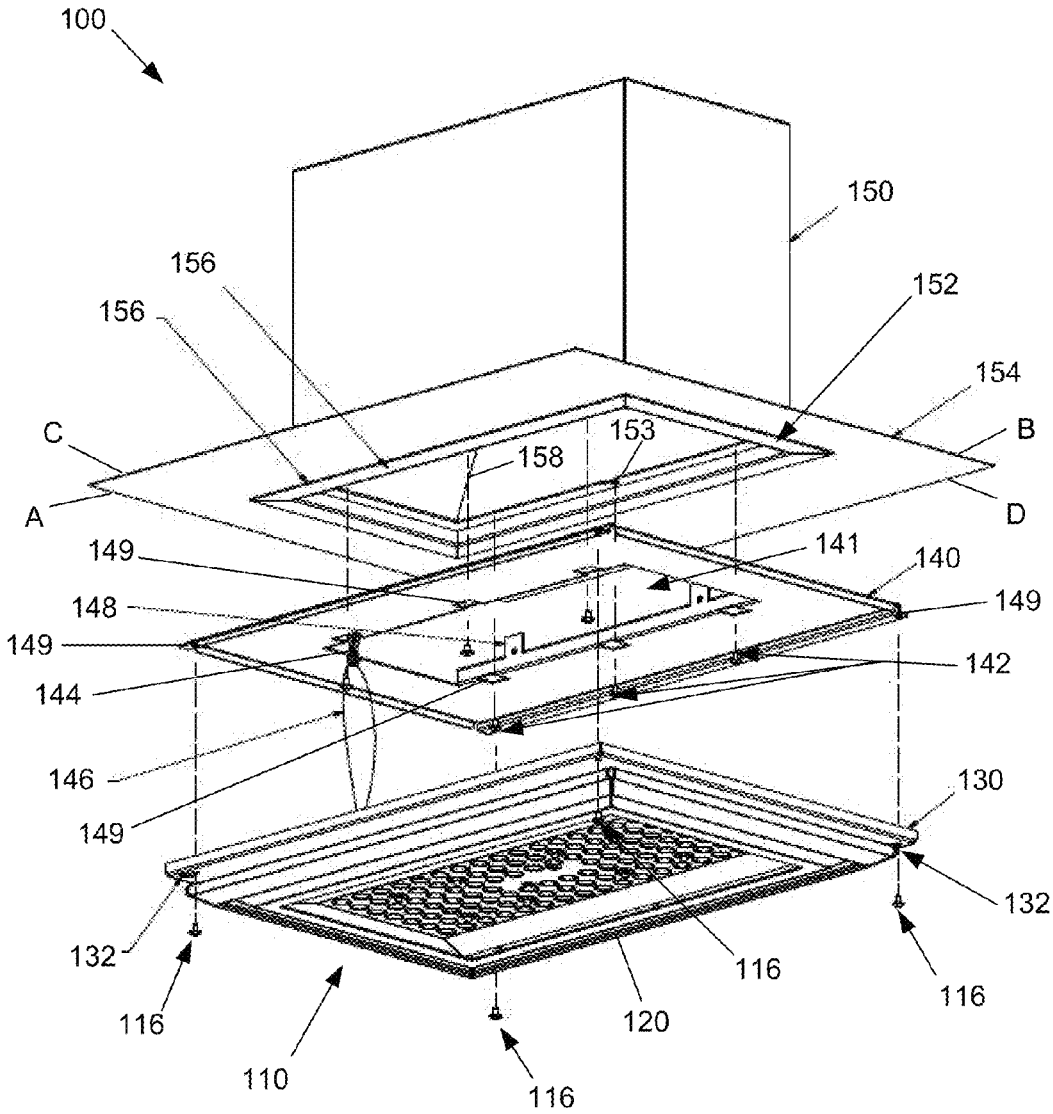
FIG. 1 is an exploded view of a lighting apparatus, in accordance with exemplary embodiments of the present disclosure.

While certain embodiments are depicted in the drawings, one skilled in the art will appreciate that the embodiments depicted are illustrative and that variations of those shown, as well as other embodiments described herein, may be envisioned and practiced within the scope of the present disclosure. Accordingly, the drawings and detailed description are to be regarded as illustrative in nature and not as restrictive.

DETAILED DESCRIPTION

In the following detailed description, numerous specific details are set forth to provide a full understanding of aspects and embodiments of the present disclosure. It will be apparent, however, to one ordinarily skilled in the art that aspects and embodiments of the present disclosure may be practiced without some of these specific details. In other instances, well-known structures and techniques have not been shown in detail to for ease in comprehension.

Embodiments of the present disclosure are directed to lighting apparatus that are adapted for installation in housings. The housings can be pre-existing ones, such as those installed for high-intensity discharge (HID) or other types of lighting. The lighting apparatus can include a light unit (e.g., luminaire) with desired type of light source(s), for example, an array of LEDs. The apparatus can include structures that are adapted for use with the housings such that installation of a light unit requires a minimum of user effort and time. Such lighting apparatus, and related installation methods, can accordingly provide for the installation and use of high-efficiency lighting.

FIG. 1 depicts an exploded view of a lighting apparatus 100, in accordance with exemplary embodiments of the present invention. The lighting apparatus 100 includes a light panel (or luminaire) 110 that includes one or more light sources, an external mounting plate 130, and an internal mounting panel or "connector plate" 140 that is adapted to fit a housing 150. The light panel 110 can include a lighting unit 120 that includes a number of light sources, e.g., an array of commercially available LEDs, as well an optional optic (not shown) for protecting the light sources and/or directing/focusing optical output.

The housing 150 may have a flange 152 and a canopy 154, as shown. The flange 152 may have a surface 153 projecting inward as shown. Surface 153 may be spaced apart (vertically and/or horizontally) from the canopy 154. Optional moisture shield 158 is also shown. The light panel 110 can be fit or connected to the housing 150 by the external mounting plate 130 and the connector plate 140. The external mounting panel 130 can be connected to the connector plate 140 by a desired number of fasteners, e.g., screws 116, as shown. The connector plate 140 includes an aperture 141 and is adapted to fit with flange 152 and/or 153 of the housing 150. and is adapted to the housing 150. The connector plate 140 includes a number of fastener structures 149, e.g., surfaces or apertures (threaded or unthreaded) for receiving screws 142 or bolts and the like. The fastener structure 149 can be located at desired location on the connector plate 140, e.g., around an outer perimeter and in inner perimeter, as shown.

The lighting unit 120 can be of any suitable type. Exemplary embodiments can include a CRO LED 100 unit made available by LSI Industries Inc. Other suitable lighting units, and related drivers or power control units, are described in co-owned U.S. patent application Ser. No. 12/582,654, filed Oct. 20, 2009 and entitled "Solid State Lighting, Driver Circuits, and Related Software," the entire contents of which are incorporated herein by reference.

When assembled, the light panel 110 can be connected to the housing 150 by way of the external mounting plate 130 and the connector plate 140. Sealant 156 may be applied, e.g., in a bead around the flange 152 and a bead on the canopy 154, to facilitate sealing of the connector plate 140 to the housing 150. Any suitable sealant may be used, e.g., RTV compounds or silicone-based compounds. A related ballast or driver (not shown) for the light panel 110 can be positioned in the opening, or aperture 141, of the connector plate 140. The connector plate 140 itself can be attached to the housing 150 by a desired number of connections/fasteners 142, e.g., six screws, with three #10 screws placed through existing self-locking sheet-metal receivers or resilient clips (e.g., so-called "Tinnerman" clips) and three self-drilling #10 screws used, as shown.

With continued reference to FIG, 1, for added safety and ease in the installation process, e.g., during a retrofit installation, a safety hook 144 (or clasp) may be present on the connector plate 140, as shown. In installation, a safety cable 146 (or tether) that is connected to the external mounting panel 130 and light panel 110 can be hung on the hook 144, allowing the connector plate 140 and housing 150 to hold the weight of the light panel 110. For example, during installation, the exterior (or, outer) mounting panel 130 that has a light unit 110 (e.g., a LED unit) and a driver mounting plate (e.g., plate 262 of FIG. 2) attached to it can be held to the connector plate 140 temporarily via a steel tether 146 and clasp 144 while the wiring portion of the installation is done. After that, the exterior mounting panel 130 can be swung into position and attached to the connector plate via fasteners, e.g., (4) #10 screws, to complete the installation. Security clips 148 may be present for securing the connector plate 140 to the housing 150, e.g., by an installer bending them over and against an inner surfaced of the housing 150. The external mounting plate 130 itself can also have features for facilitating ease (including speed) and safety of an installation process. For example, in some applications the external mounting plate 130 can have one or more keyhole slots 132 (preferably at opposite corners, as shown) allowing for quick hanging of the external mounting plate 130 and light panel 110 on the connector plate 140 and housing 150.

In exemplary embodiments, a housing, e.g., housing 150 of FIG. 1, can be a pre-existing housing, such as one used for. high-intensity discharge (HID) lighting. Common types of HID housings include, but are not limited to, so-called Richmond (or "RIC") housings made available by LSI Industries Inc., so-called Whiteway Civic ("CVC") housings made available by Hubbell Lighting Inc., and Icon housings made available by Jet-Phillips Lighting. Of course, embodiments of the present disclosure can be used with any other suitable type of housing.

Figure 2:
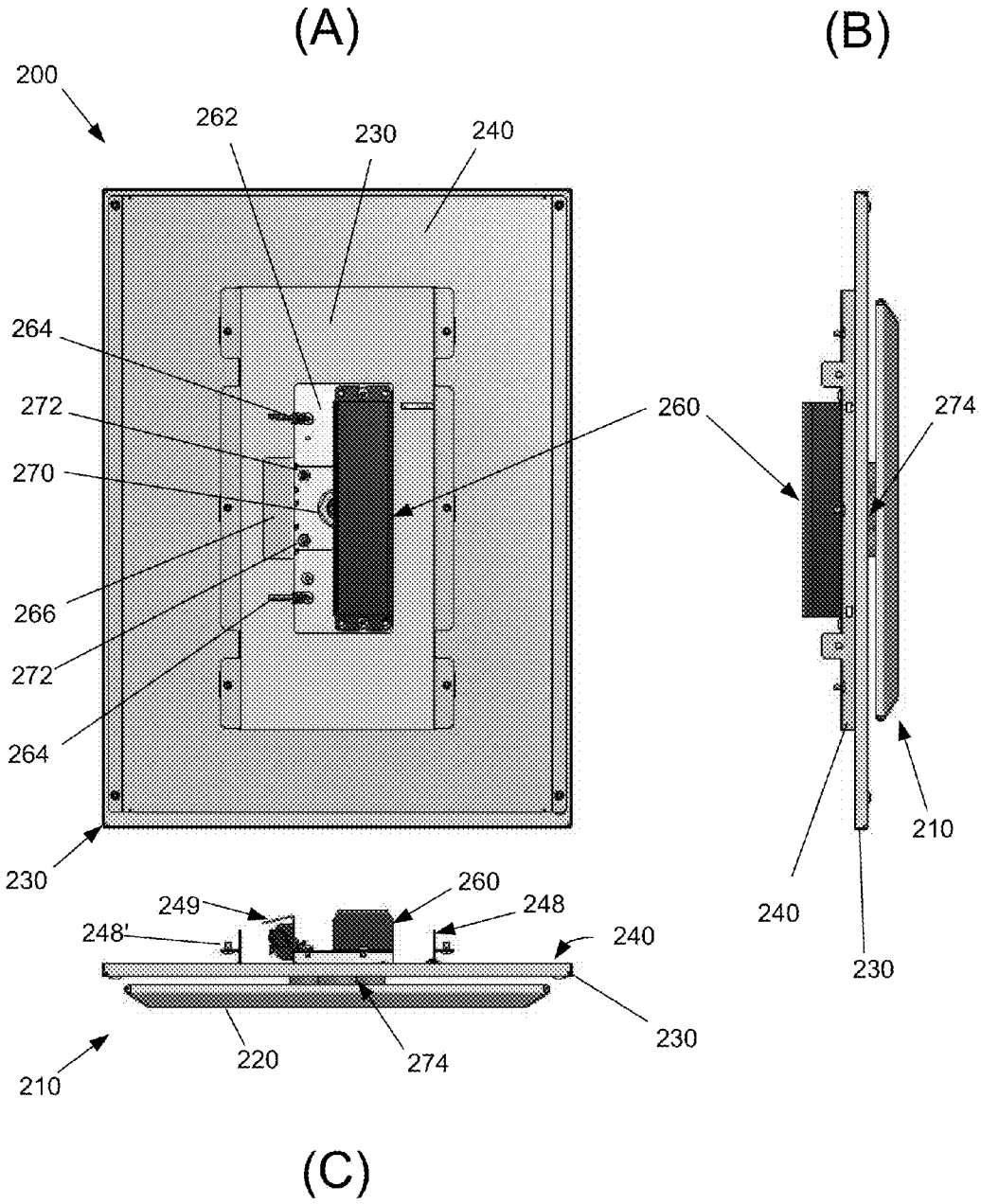
FIG. 2 includes three views (A)-(C) showing a lighting apparatus, in accordance with exemplary embodiments of the present disclosure.

FIG. 2 includes three views (A)-(C) showing a lighting apparatus assembly 200, in accordance with exemplary embodiments of the present disclosure. View (A) depicts a top view of the assembly 200, which includes a light panel 210, an external mounting panel 230, and a connector plate 240 with attached driver (power control unit) 260 and supporting driver plate 262. Views (B)-(C) depict orthogonal side views of (A), one perpendicular to the long axis and one perpendicular to the short axis of the apparatus 200.

As shown in FIG. 2, the external mounting panel 230 can be connected to the connector plate 240 and also to the light panel 210, e.g., by central threaded connection 270 and threaded connectors 272 (only two or four are shown). Central threaded connection 270 can be hollow to facilitate electrical connection between the light panel 210 and the driver 260. The driver 210 can be supported on a support surface, e.g., driver plate 262. Optional moisture shields 249 may be present. As shown in views (B) and (C), a gasket 274 may be present to provide improved sealing of the assembly 200.

FIG. 2 also shows that the connector plate 240 can include one or more tabs or flanges 248 with support surfaces adapted to mate (e.g., by way of fastener 248') with the inner surface of the related housing flange (e.g., surface 153 of FIG. 1).

Figure 3:
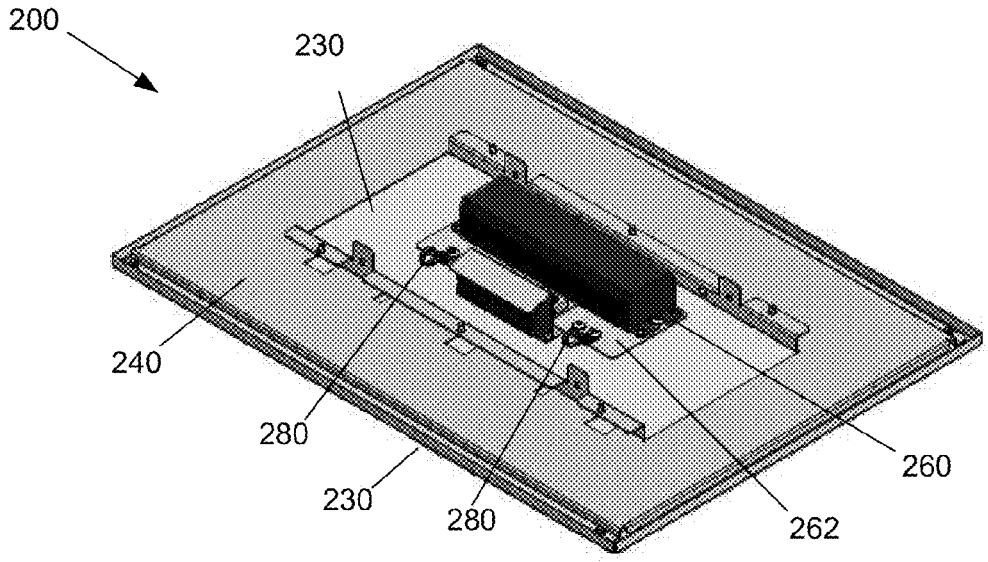
FIG. 3 depicts a perspective view of a connector plate with ballast, in accordance with exemplary embodiments of the present disclosure.

FIG. 3 depicts a perspective view of the assembly 200 of FIG. 2. The view shows the external mounting plate 230 connected to the connector plate 240 and driver plate 262. Optional ground straps 280 are also shown.

Figure 4:
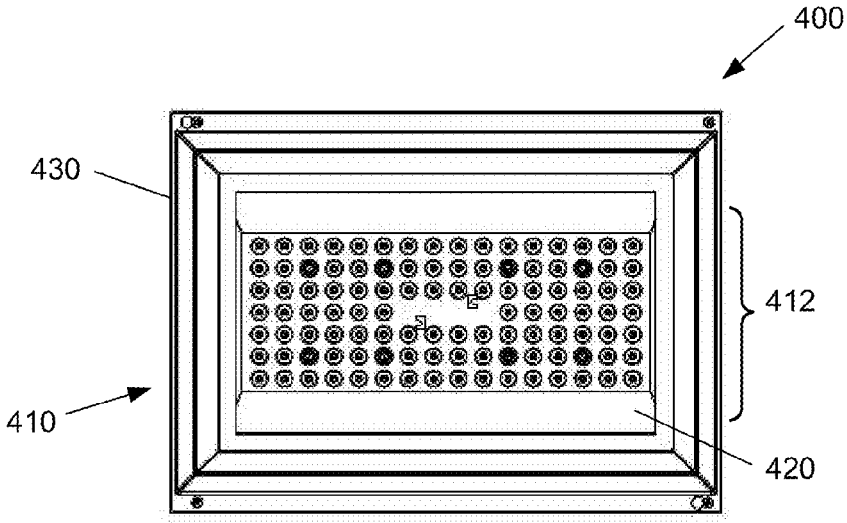
FIG. 4 depicts a plan view showing a light panel installed on an external mounting panel, in accordance with exemplary embodiments of the present disclosure.

FIG. 4 depicts a plan view showing a light panel assembly 400, in accordance with exemplary embodiments of the present disclosure. The light panel assembly 400 can include a light panel 410 that includes one or more light sources. In the drawing, light panel 410 is shown as installed on an external mounting plate 430. The light panel can include an optic 420 for protecting light sources. In exemplary embodiments, the light sources can include an array of LEDs 412, as indicated.

Figure 5:
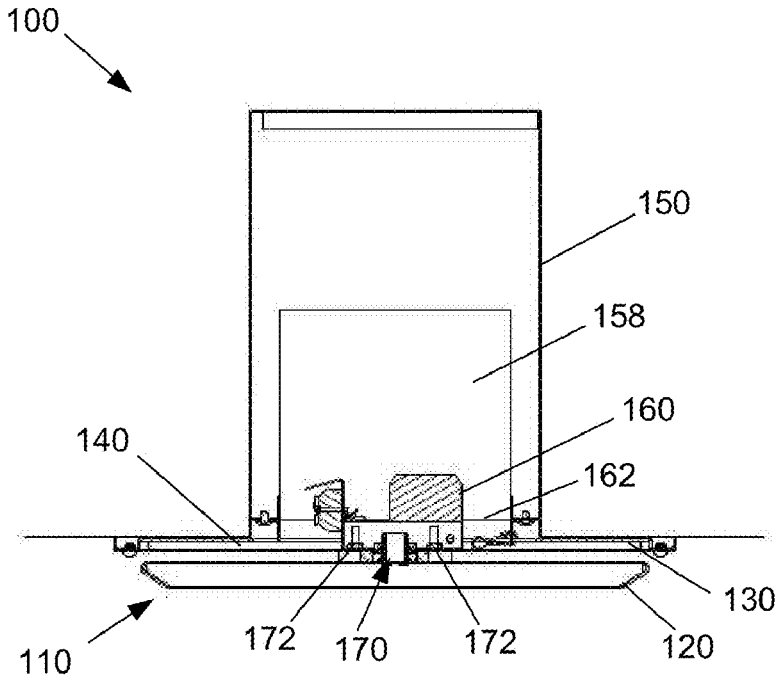
FIG. 5 depicts a cross-section of the apparatus of FIG. 1.

FIG. 5 depicts a cross-section of the apparatus 100 of FIG. 1, taken along cutting plane parallel to sides A-B of the housing canopy 154. The reference characters of FIG. 1 are used for the drawing. Threaded connections 170, 172 between the external mounting panel 130 and light panel (luminaire) 110 are shown.

Figure 6:
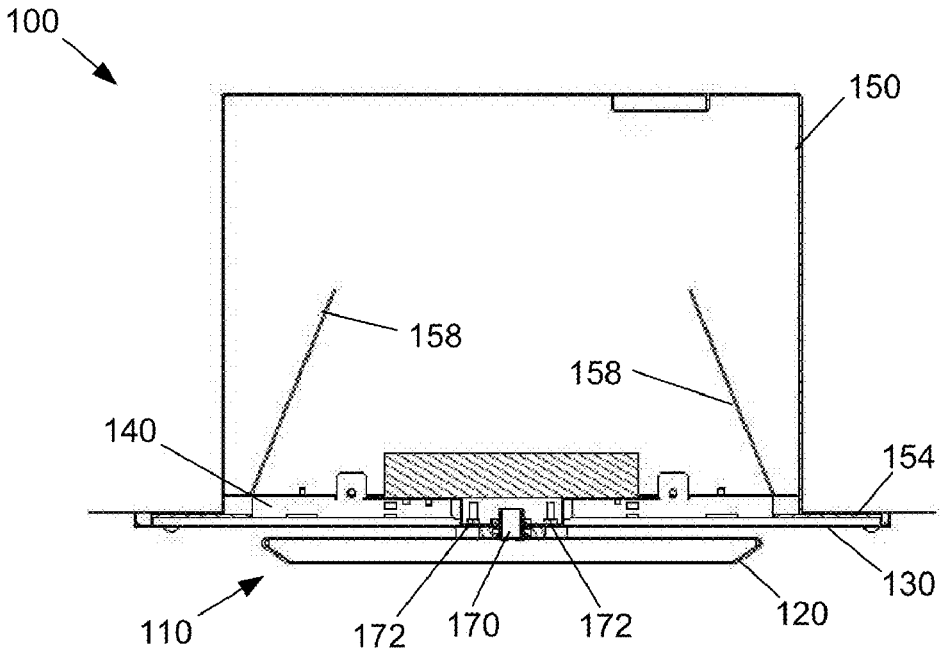
FIG. 6 depicts a further cross-section of the apparatus of FIG. 1.

FIG. 6 a further cross-section of the apparatus 100 of FIG. 1, taken along cutting plane parallel to sides C-D of the housing canopy 154. The reference characters of FIG. 1 are used for the drawing.

Figure 7:
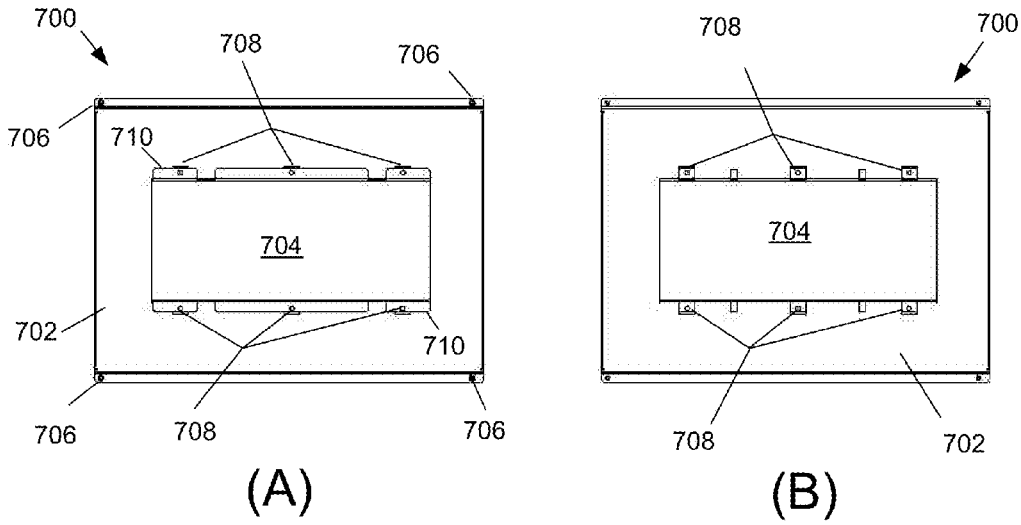
FIG. 7 includes a set of drawings (A)-(B) showing a top and bottom view of a connector plate, respectively, in accordance with an exemplary embodiment of the present disclosure.

FIG. 7 includes a set of drawings showing a top (A) and bottom (B) view of a connector plate 700, respectively, in accordance with an exemplary embodiment of the present disclosure. Connector plate 700 includes a body 702 made of a suitable material, e.g., sheet metal, and includes an opening or aperture 704. A number of fastener structures, e.g., holes 706 (threaded or non-threaded) can be located around an outer perimeter of the connector plate 700. A number of fastener structures, e.g., holes 708 (threaded or non-threaded) can be located around an inner perimeter of aperture 704. The holes, e.g., 708, can have associated surfaces or tabs. As shown in view (A), the inner perimeter of aperture 704 can have tabs or flanges that provide support surfaces 710 spaced apart from and substantially parallel to the body 702. Such surfaces 710 can be used to connect to a flange (or inner surface) of a related housing (e.g., one that the connector plate has been deigned to fit or be adapted to).

Figure 8:
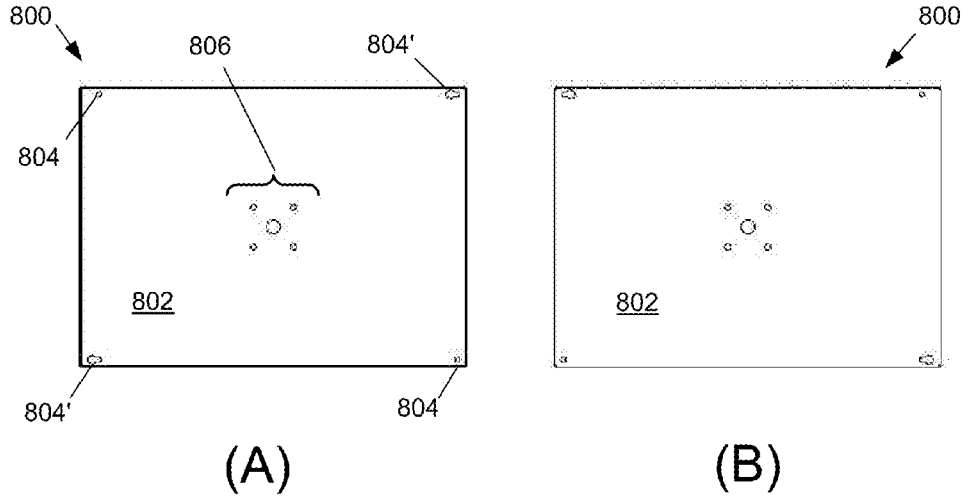
FIG. 8 includes a set of drawings (A)-(B) showing a top and bottom view, respectively, of an external mounting panel, respectively, in accordance with an exemplary embodiment of the present disclosure.
Figure 9:
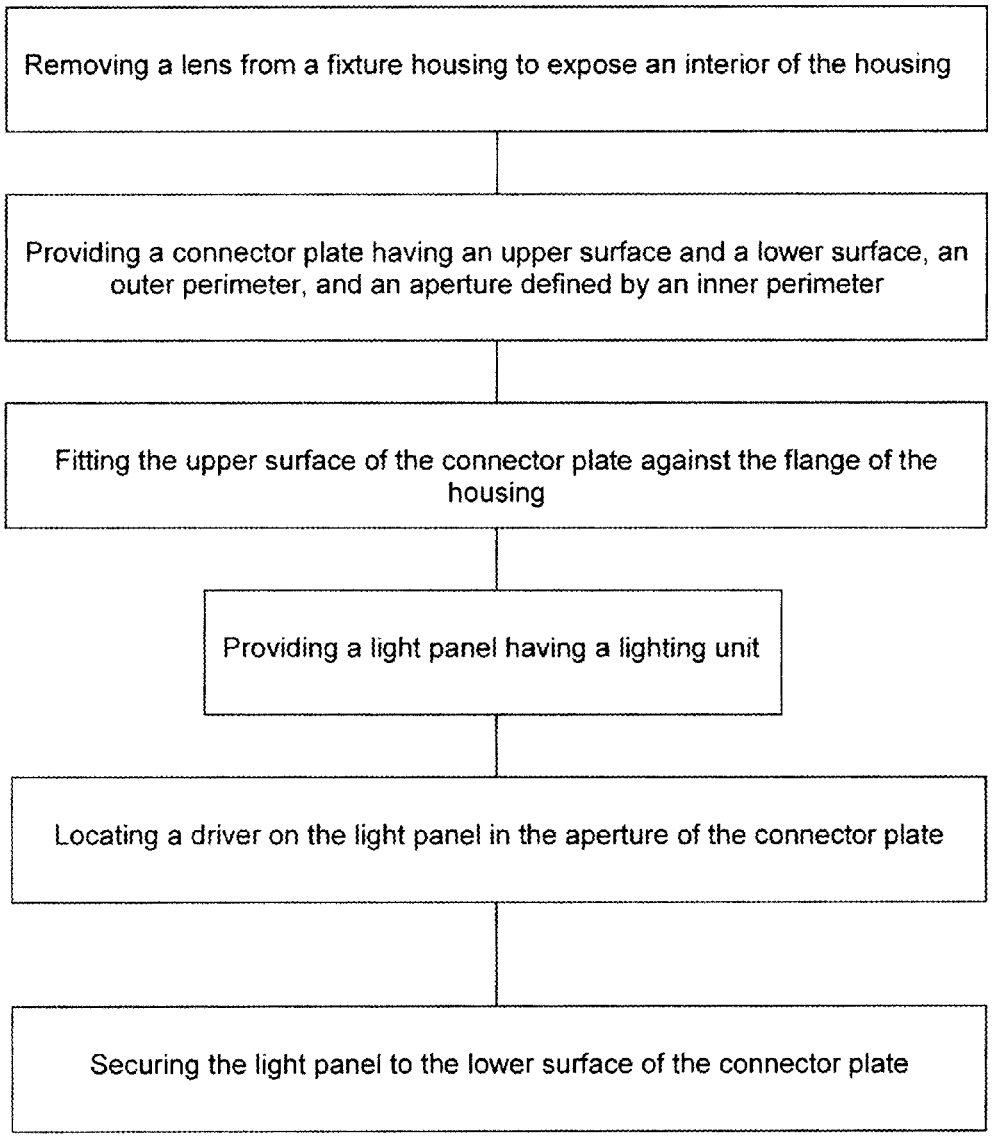
FIG. 9 depicts an exemplary embodiment of the steps of a method of installing a lighting apparatus in an existing fixture housing.

FIG. 8 includes a set of drawings showing a top (A) and bottom (B) view of an external mounting panel 800, respectively, in accordance with an exemplary embodiment of the present disclosure. The external mounting panel 800 includes a body 802 made of suitable material, e.g., sheet metal. A number of fastener holes 804 may be present to facilitate connection with a related connector plate, e.g., plate 700 of FIG. 7.

FIG. 8 also shows that keyholes 804' may be used. Such holes can allow for quick installation of the external mounting plate 800 and any attached light panel (not shown). Apertures/holes 806 can be provided to allow for connection (structural and/or electrical) of the external mounting panel to a light panel.

Accordingly, embodiments of the present disclosure can provide benefits relative to previous techniques. For example, embodiments of the present disclosure can provide for quick and easy retrofitting of improved lighting, with light sources and power control unit, into pre-existing light housings such as HID housings.

While certain light panels have been described with particularity, others are contemplated within the scope of the present disclosure. For example, light panels or housings with adjustable light cartridges such as shown and described in co-owned U.S. application Ser. No. 12/254,104 may be used. Other suitable light panels may also be used.

While aspects of the present disclosure are described herein in connection with certain embodiments, it should be noted that variations can be made by one with skill in the applicable arts within the spirit of the present disclosure. For example, while the light housings have been described herein as pre-existing, embodiments of the present disclosure can provide housings for lighting apparatus. Moreover, while fasteners have been described herein as including screws, other types of fasteners may used in place of or in addition, e.g., bolts, rivets, snap-fit connections. Further, materials used for the components and structure described herein as not limited to metal or sheet metal; for example, suitably strong plastics and/or composite materials may be used.

Various functions and elements described herein may be partitioned differently from those shown without departing from the spirit and scope of the present disclosure. Various modifications to these embodiments will be readily apparent to those skilled in the art, and generic principles defined herein may be applied to other embodiments. Thus, many changes and modifications may be made, by one having ordinary skill in the art, without departing from the spirit and scope of the present disclosure and claimed embodiments.

One skilled in the art will appreciate that embodiments and/or portions of embodiments of the present disclosure can be implemented in/with computer-readable storage media (e.g., hardware, software, firmware, or any combinations of such), and can be distributed over one or more networks. Steps described herein, including processing functions to derive, learn, or calculate formula and/or mathematical models utilized and/or produced by the embodiments of the present disclosure, can be processed by one or more suitable processors, e.g., central processing units ("CPUs), implementing suitable code/instructions in any suitable language (machine dependent on machine independent).

Additionally, embodiments of the present disclosure can be embodied in signals and/or carriers, e.g., control signals sent over a communications channel or network. Furthermore, software embodying methods, processes, and/or algorithms of the present disclosure can be implemented in or carried by electrical signals, e.g., for use with the Internet and/or wireless networks.

What is claimed is:

1. A lighting apparatus adapted for installation in a canopy with a fixture housing extending through the canopy and having a flange at a lower end thereof surrounding an opening in the fixture housing, the apparatus comprising:

a connector plate having an upper surface, a lower surface, an outer perimeter, and an aperture defined by an inner perimeter, wherein the connector plate is adapted to fit against the flange of the housing, wherein the connector plate is configured and arranged to securably receive a light panel including a lighting unit such that a driver for the light panel is positioned in the aperture of the connector plate.

2. The lighting apparatus of claim 1, wherein the connector plate includes fastener structures adjacent the inner perimeter and adjacent the outer perimeter.

3. The lighting apparatus of claim 1, further comprising a lighting power unit for operating the lighting unit and electrically coupled to the lighting unit.

4. The lighting apparatus of claim 3, wherein the lighting power unit is supported on a driver plate secured to the connector plate.

5. The lighting apparatus of claim 1, wherein the flange includes one or more resilient clips.

6. The lighting apparatus of claim 1, wherein the light panel comprising an external mounting panel configured and arranged to releasably secure to the connector plate.

7. The lighting apparatus of claim 1, wherein the exterior mounting panel comprises two keyhole slots for receiving respective fasteners.

8. The lighting apparatus of claim 1, wherein the housing flange includes an inner surface that is spaced apart from a canopy of the housing, and wherein the connector plate further comprises one or more tabs with support surfaces adapted to mate with the inner surface of the housing flange.

9. The lighting apparatus of claim 1, wherein the lighting unit comprises a plurality of LEDs.

10. The lighting apparatus of claim 1, wherein the lighting unit comprises a housing having an optic.

11. The lighting apparatus of claim 1, further comprising sealant disposed between the connector plate and the housing flange.

12. The lighting apparatus of claim 1, further comprising a plurality of fasteners connecting the connector plate to the housing flange.

13. The lighting apparatus of claim 1, further comprising a plurality of fasteners connecting the external mounting panel to the connector plate.

14. The lighting apparatus of claim 1, further comprising a plurality of fasteners connecting the light panel to the external mounting panel.

15. A method of installing a lighting apparatus in an existing fixture having a housing with a flange at a lower end thereof surrounding and defining an opening in the fixture housing, a power source, a first lamp socket and a lens, the method comprising:

removing the lens to expose the interior of the housing;

providing a connector plate having an upper surface and a lower surface, an outer perimeter, and an aperture defined by an inner perimeter, fitting the upper surface of the connector plate against the flange of the housing, providing a light panel having a lighting unit;

locating a driver on the light panel in the aperture of the connector plate; and securing the light panel to the lower surface of the connector plate.

16. The method of claim 15, further comprising providing an external mounting panel and connecting the light panel to the external mounting panel.

17. The method of claim 15, further comprising connecting the connector plate to the housing flange.

18. The method of claim 15, further comprising providing an external mounting panel and connecting the external mounting panel to the connector plate.

19. The method of claim 18, wherein connecting the external mounting panel to the connector plate comprises connecting a safety hook attached to the connector plate to a safety cable connected to the external mounting panel.

20. The method of claim 15, further comprising providing a power control unit.

21. The method of claim 15, further comprising applying sealant between the flange and the connector plate.

22. The method of claim 15, wherein the housing flange includes an inner surface that is spaced apart from a canopy of the housing, and wherein the connector plate further comprises one or more tabs with support surfaces adapted to mate with the inner surface of the housing flange.

23. The method of claim 15, wherein the light unit comprises a plurality of LEDs.

* * * * *